US009507307B2

(12) United States Patent
Ishihara

(10) Patent No.: US 9,507,307 B2
(45) Date of Patent: Nov. 29, 2016

(54) IMAGE FORMING APPARATUS

(71) Applicant: CANON KABUSHIKI KAISHA, Tokyo (JP)

(72) Inventor: Shotaro Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,257

(22) Filed: May 20, 2015

(65) Prior Publication Data

US 2015/0338808 A1 Nov. 26, 2015

(30) Foreign Application Priority Data

May 23, 2014 (JP) ..... 2014-107211

(51) Int. Cl.

| | |
|---|---|
| ***G03G 15/00*** | (2006.01) |
| ***G03G 15/20*** | (2006.01) |
| ***G03G 15/23*** | (2006.01) |
| ***B65H 85/00*** | (2006.01) |
| ***B65H 7/02*** | (2006.01) |
| ***G03G 21/14*** | (2006.01) |
| ***B65H 29/12*** | (2006.01) |

(52) U.S. Cl.

CPC ..... *G03G 15/2085* (2013.01); *B65H 7/02* (2013.01); *B65H 29/125* (2013.01); *B65H 85/00* (2013.01); *G03G 15/00* (2013.01); *G03G 21/14* (2013.01); *B65H 2301/33312* (2013.01); *B65H 2301/4493* (2013.01); *B65H 2511/416* (2013.01); *B65H 2513/512* (2013.01); *B65H 2513/514* (2013.01); *B65H 2601/212* (2013.01); *B65H 2701/1311* (2013.01); *B65H 2801/06* (2013.01)

(58) Field of Classification Search

CPC ..... G03G 15/00; G03G 15/20; G03G 15/23; G03G 21/00; G03G 21/14; G03G 21/20; G03G 15/2085

USPC ..... 399/401

See application file for complete search history.

(56) References Cited

U.S. PATENT DOCUMENTS 5,987,300 A * 11/1999 Mori ..... G03G 15/231 399/401
2011/0103808 A1* 5/2011 Abe ..... G03G 15/234 399/16
2013/0187330 A1* 7/2013 Kuroda ..... B41J 3/60 271/225

FOREIGN PATENT DOCUMENTS

JP 2011-191544 A 9/2011

* cited by examiner

*Primary Examiner* — Nguyen Ha
(74) *Attorney, Agent, or Firm* — Canon USA, Inc. I.P. Division

(57) ABSTRACT

An image forming apparatus includes an image forming unit configured to form a toner image on a sheet, a fixing unit configured to fix the toner image on the sheet, a double-sided conveyance path along which the sheet is conveyed for double-sided printing, and a control unit configured to control conveyance of the sheet, allowing the sheet to be stopped at a first standby position which is more downstream than the fixing unit in a sheet conveyance direction on the double-sided conveyance path and a second standby position which is more downstream than the first standby position, and changing stopping time for which the sheet is stopped at the first standby position and stopping time for which the sheet is stopped at the second standby position according to a material of the sheet.

22 Claims, 8 Drawing Sheets

IMAGE FORMING APPARATUS

BACKGROUND OF THE INVENTION

Field of the Invention

The present invention relates to reduction in dew condensation on a sheet conveying path of an image forming apparatus.

Description of the Related Art

Heretofore, at the time of performing double-sided printing, a sheet whose one side has been printed and the other side will be printed is stopped at a predetermined position of a sheet conveying path in an image forming apparatus. The printing of the other side starts after a control unit of the image forming apparatus receives a paper feed signal. Since the sheet passing a fixing unit stops at the same position for a certain period of time at a position where the sheet is stopped in the image forming apparatus, dew condensation occurs due to water vapor discharged from the sheet, which may cause image defect. Japanese Patent Application Laid-Open No. 2011-191544 discusses a configuration in which a cooling unit to cool a sheet is provided at a position where the sheet stops and the time for which the sheet is stopped is changed to prevent productivity from being lowered.

However, heretofore, there has been only one position where the sheet is stopped at the time of performing double-sided printing, so that it takes a long time for the sheet to stay always at the same standby position. This is liable to cause dew condensation in winter or in a state where the temperature of a conveyance guide is low, such as immediately after a power source is turned on. The time for which water vapor is discharged from the sheet and the quantity of the water vapor discharged therefrom are different depending on air permeance of the sheet, which makes it difficult to propose a configuration which does not cause the dew condensation for all materials only at one standby position. The term "air permeance of the sheet" refers to a degree to which air passes through the sheet in a direction of depth thereof. In addition, if the cooling unit is provided at the position where the sheet is stopped as is conventionally done, which may increase cost.

SUMMARY OF THE INVENTION

The present invention lowers generation of dew condensation in an image forming apparatus at a low cost without lowering productivity.

According to an aspect of the present invention, an image forming apparatus, which forms an image on one face of a sheet and the other face thereof different from the one face, includes an image forming unit configured to form a toner image yet to be fixed on the sheet, a fixing unit configured to fix the toner image formed by the image forming unit on the sheet, a double-sided conveyance path along which the sheet is conveyed to form, after a toner image is fixed to one face of the sheet by the fixing unit, a toner image on the other face of the sheet, and a control unit configured to control conveyance of the sheet. The control unit allows the sheet to be stopped at a first standby position which is more downstream than the fixing unit in a sheet conveyance direction on the double-sided conveyance path and a second standby position which is more downstream than the first standby position, and changes stopping time for which the sheet is stopped at the first standby position and stopping time for which the sheet is stopped at the second standby position according to a material of the sheet.

Further features of the present invention will become apparent from the following description of exemplary embodiments with reference to the attached drawings.

BRIEF DESCRIPTION OF THE DRAWINGS

FIGS. 6A, 6B, and 6C are charts illustrating standby control using a material 2 as the sheet.

DESCRIPTION OF THE EMBODIMENTS

An image forming apparatus according to an exemplary embodiment of the present invention is described below with reference to the attached drawings. The image forming apparatus according to the present exemplary embodiment is an intermediate-transfer image forming apparatus such as a copy machine, a printer, a facsimile, and a multifunction apparatus including the functions thereof, which transfers a toner image to an intermediate transfer belt and then to a sheet. The following describes an example of the intermediate-transfer image forming apparatus in which image forming units of four colors are arranged on the intermediate transfer belt, however, the configuration of the image forming apparatus is not limited to this configuration.

(Entire Configuration of Image Forming Apparatus)

Figure 1:
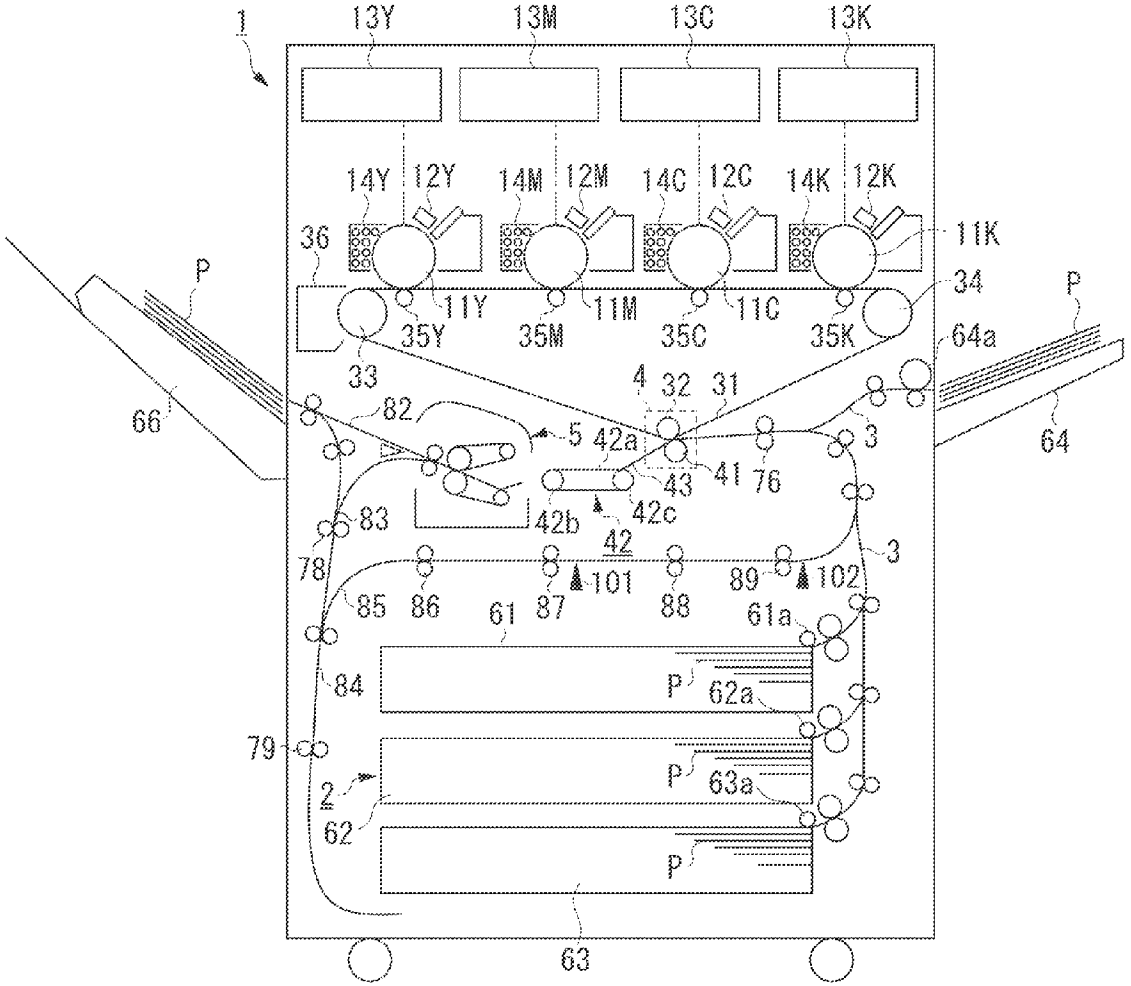
FIG. 1 is a cross section illustrating an entire configuration of an image forming apparatus according to an exemplary embodiment.

An entire configuration of an image forming apparatus 1 according to the present exemplary embodiment is described below with reference to FIG. 1. FIG. 1 is a schematic cross section illustrating the entire configuration of the image forming apparatus 1 according to the present exemplary embodiment. A process for a sheet P conveyed to a secondary transfer unit 4 (indicated by a dotted-line frame) with the use of a sheet feeding unit 2 is described below. The sheet P is stored in sheet cassettes 61, 62, and 63 provided at a lower portion of the image forming apparatus, and fed from each of the sheet cassettes 61, 62, and 63 by their respective feeding rollers 61*a*, 62*a*, and 63*a*. In the present exemplary embodiment, a manual feeding tray 64 to which the sheet P can be manually fed is provided on the side surface of the image forming apparatus. The sheet P can also be fed from the manual feeding tray 64 by a feeding roller 64*a*. The sheets P fed by the feeding rollers 61*a* to 64*a* are separated one by one by a separation member and conveyed via a conveyance path 3 to a registration roller pair 76 arranged on the upstream side of the secondary transfer unit 4 in a direction in which the sheet is conveyed.

At a position of the registration roller pair 76, the leading edge of the fed sheet P abuts against a nip portion formed by the registration roller pair 76 that stops rotating, so that deflection is formed on the sheet. The deflection is formed on the sheet P to correct skew in a region of the leading edge of the sheet P along the nip portion of the registration roller pair 76. The registration roller pair 76 conveys the sheet P to the secondary transfer unit 4 at a predetermined timing, in accordance with the timing when an image is formed on the sheet P, that is, in accordance with the rotation of an intermediate transfer belt 31 to which a toner image is transferred. Thus, the registration roller pair 76 corrects the skew of the sheet P and conveys the sheet P to the secondary transfer unit 4 at the predetermined timing.

The surfaces of four photosensitive drums 11Y, 11M, 11C, and 11K are uniformly charged by charging units 12Y, 12M, 12C, and 12K, respectively. Laser scanners 13Y, 13M, 13C, and 13K receive yellow (Y), magenta (M), cyan (C), and black (K) image signals, respectively. The laser scanners 13Y, 13M, 13C, and 13K radiate the surfaces of the photosensitive drums 11Y, 11M, 11C, and 11K with laser beams to form latent images on the photosensitive drums 11Y, 11M, 11C, and 11K. Hereinafter, subscripts indicating colors Y, M, C, and K are omitted unless they are necessary.

The latent images formed on the photosensitive drums are developed by developing units 14 in yellow, magenta, cyan, and black. The toner images developed on the drums 11 are transferred in order by primary transfer rollers 35 to an intermediate transfer belt 31 acting as an endless-belt-shaped image bearing-member to form full-color toner images on the intermediate transfer belt 31. The intermediate transfer belt 31 bears the transferred full color toner images, and conveys the full color toner images to the secondary transfer unit 4. The intermediate transfer belt 31 is stretched among a drive roller 33, a tension roller 34, and a secondary transfer inner roller 32, and rotated by rotationally driving the drive roller 33. The toner remaining on the intermediate transfer belt 31 without being transferred is cleaned by a transfer cleaning unit 36.

A transfer process performed by the secondary transfer unit 4 and subsequent processes are described below. The secondary transfer unit 4 includes the secondary transfer inner roller 32 and a secondary transfer outer roller 41 opposing the secondary transfer inner roller 32. The secondary transfer unit 4 is a nip portion formed of the secondary transfer inner roller 32 and the secondary transfer outer roller 41, and provides the sheet P with a predetermined pressure force and an electrostatic load voltage to transfer full-color toner images on the intermediate transfer belt 31 to the sheet P.

The full-color toner images are transferred to the sheet P and then the sheet P is conveyed to a fixing unit 5 by a sheet conveyance unit 42. The sheet conveyance unit 42 includes a conveyance belt 42*a* shaping of an endless-belt, which is stretched between a conveyance-belt drive roller 42*b* and a conveyance-belt tension roller 42*c*. Further, the conveyance-belt 42*a* is rotationally driven in the direction in which the sheet P is conveyed from the secondary transfer unit 4 to the fixing unit 5. The conveyance belt 42*a* is provided with countless air vents for suction. The sheet P is sucked by a negative pressure generated by a fan (not illustrated) to the surface of the conveyance belt 42*a* and conveyed along with the movement of the conveyance belt 42*a*.

A sheet conveyance path between the secondary transfer unit 4 and the sheet conveyance unit 42 is defined by a lower guide 43 arranged between the secondary transfer unit 4 and the sheet conveyance unit 42. Because the toner image is transferred to the upper surface of the sheet P, an upper guide for guiding the upper surface of the sheet P is not provided at the upper portion of the lower guide 43. Therefore, the sheet P is guided along the upper surface of the lower guide 43.

The fixing unit 5 applies a predetermined pressure force by opposing rollers or a belt and a predetermined heat by a heat source such as a heater to melt and fix the toner image (not yet fixed) transferred to the sheet P. The sheet P to which the toner image is fixed is discharged onto a discharge tray 66 via a discharge conveyance path 82. If a double-sided printing for forming an image on the other side (hereinafter referred to as back surface) of the sheet P is set, the sheet P on which an image is formed on one side thereof (hereinafter referred to as front surface) is conveyed to a reverse path 83 and is drawn into a switch back path 84 from the reverse path 83. A reverse roller pair 79 is normally rotated and then reversely rotated, which is called as a switch back operation, to change a conveyance direction of the sheet P, and the sheet P is conveyed to a double-sided conveyance path 85. Thereafter, the sheet P is conveyed to double-sided rollers 86 and 87 driven by a double-sided motor 204 described below in FIG. 2A and to double-sided rollers 88 and 89 driven by a double-sided motor 205 described below in this order. The double-sided rollers 86 and 87 acting as first conveyance means are provided more upstream than a conveyance sensor 101 acting as first detection means. The double-sided rollers 88 and 89 acting as second conveyance means are provided more downstream than the conveyance sensor 101 (hereinafter simply referred to as downstream side) and more upstream than a conveyance sensor 102 acting as second detection means.

The sheet P conveyed to the double-sided conveyance path 85 is conveyed in a timely manner not to interfere with a succeeding sheet P fed from any one of the sheet cassettes 61 to 63 and the manual feeding tray 64. The sheet P conveyed to the double-sided conveyance path 85 is conveyed again to the secondary transfer unit 4 via the registration roller pair 76. An image forming process on the back surface of the sheet P is similar to the above described process on the front surface of the sheet P, so that the description thereof is omitted. In a case where the sheet P is turned over and discharged, the sheet P is drawn into the switch back path 84 from the reverse path 83 after the sheet P passes the fixing unit 5. Both of a reverse roller pair 78 and the reverse roller pair 79 are rotated in opposite direction to discharge the sheet P to the discharge tray 66 with the sheet P being face down.

(Standby Control of Sheet in Double-Sided Printing)

Figure 2A:
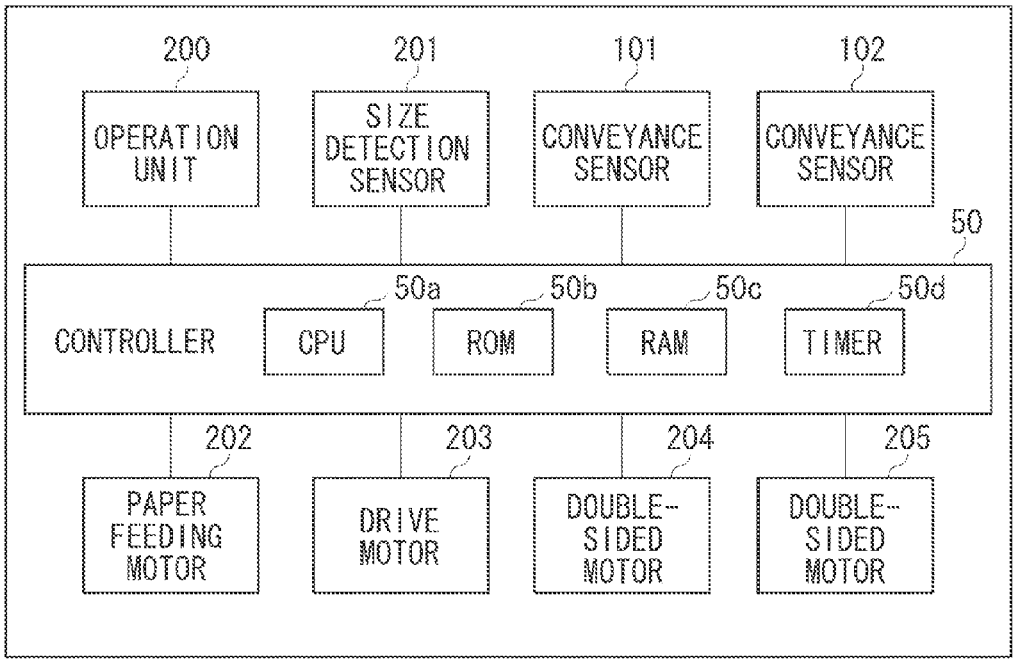
FIGS. 2A and 2B illustrate a block diagram of the image forming apparatus according to the exemplary embodiment and a flowchart of a conventional example of control at the time of conveying a sheet in double-sided printing, respectively.

FIG. 2A illustrates a block diagram of the image forming apparatus 1 according to the present exemplary embodiment. A controller 50 acting as control means is connected to an operation unit 200 of the image forming apparatus 1. Information about a material of the sheet P, information such as plain paper or coated paper, for example, is input by the operation unit 200 and sent to the controller 50. The controller 50 is connected to a size sensor 201 acting as size detection means for the sheet P, a paper feeding motor 202, a drive motor 203 acting as driving means for a conveyance roller arranged on each conveyance path of the sheet P, and double-sided motors 204 and 205. The controller 50 is connected with the conveyance sensors 101 and 102.

The controller 50 includes a central processing unit (CPU) 50*a* which controls the image forming apparatus 1 according to various control programs stored in a random access memory (ROM) 50*b* while using the RAM 50*c* as a temporal storage area. When the timing related to image forming operation is controlled, the CPU 50*a* measures time elapsing from a predetermined reference time with a timer 50*d*. The conveyance sensors 101 and 102 that are arranged on the double-sided conveyance path 85 detect the sheet P conveyed on the double-sided conveyance path 85, and output a detection result to the controller 50. The controller 50 determines that the leading edge of the sheet P reaches the conveyance sensors 101 or 102, or that the trailing edge of the sheet P passes, based on the detection result input from the conveyance sensors 101 and 102.

(Conventional Standby Control of Sheet in Double-Sided Printing)

Figure 2B:
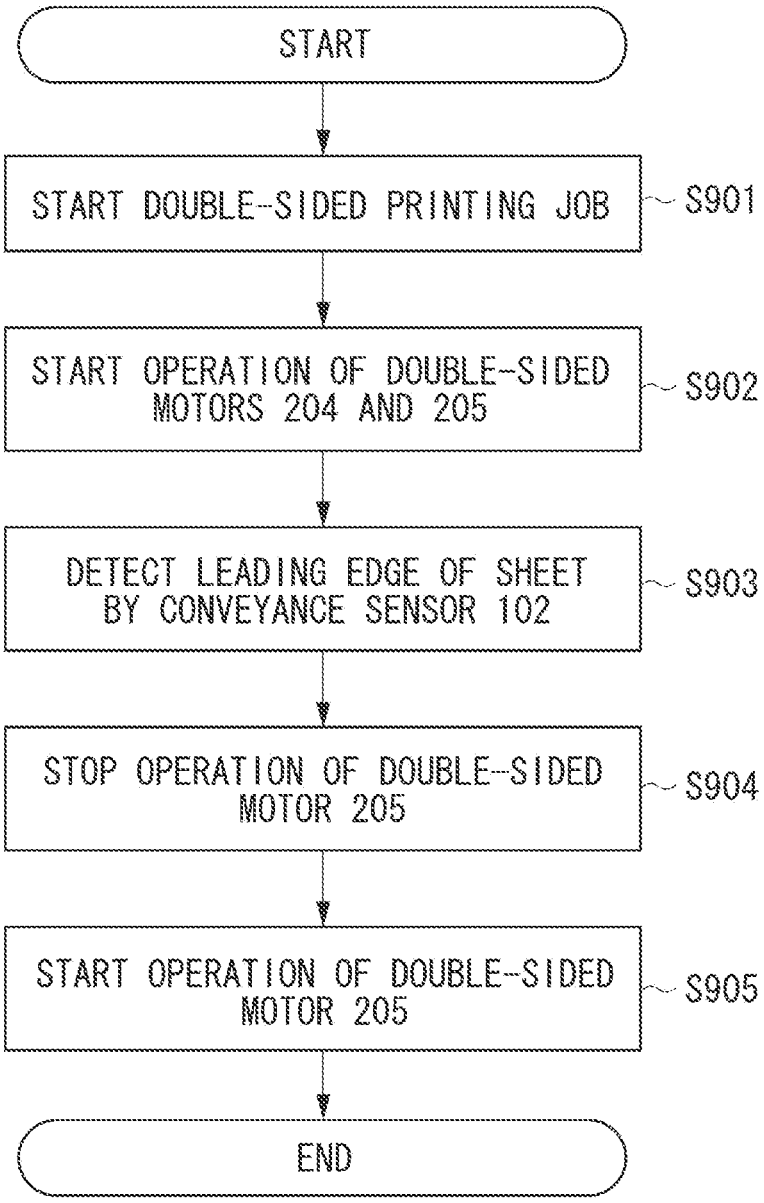
Prior Art FIG. 2B

FIG. 2B is a flowchart describing conventional standby control of the sheet P at the time of conveying the sheet P for double-sided printing (hereinafter referred to as "at the time of double-sided conveyance") in order to compare with the present exemplary embodiment. In step S901, if the controller 50 receives a double-sided printing job from the operation unit 200, for example, the controller 50 starts a double-sided printing job. In step S902, the controller 50 starts an operation of the double-sided motors 204 and 205. Drive of the double-sided rollers 86 and 87 starts by starting the operation of the double-sided motor 204. Drive of the double-sided rollers 88 and 89 starts by starting the operation of the double-sided motor 205.

In step S903, the controller 50 starts the timer 50*d* to measure elapse time according to the fact that the leading edge of the sheet P is detected by the conveyance sensor 102 arranged on the downstream side of the double-sided roller 89. In step S904, if the timer 50*d* measures a predetermined time, the controller 50 stops the operation of the double-sided motor 205. Stopping the operation of the double-sided motor 205 leads the drive of the double-sided rollers 88 and 89 to stop. A position where the leading edge of the sheet P is conveyed by 20 mm downstream from the conveyance sensor 102 along the double-sided conveyance path 85 is taken as a standby position of the sheet P, for example. The standby position of the sheet P is determined in consideration of a distance between the double-sided roller 89 and the conveyance sensor 102. The controller 50 determines the predetermined time until the leading edge of the sheet P reaches the standby position after the conveyance sensor 102 detects the leading edge of the sheet P, in the following manner. The controller 50 determines the predetermined time based on a distance of 20 mm along the double-sided conveyance path 85 from the conveyance sensor 102 to the standby position and on a predetermined conveyance speed of the sheet P.

In step S905, the controller 50 starts again the operation of the double-sided motor 205 at the timing when the sheet P is fed again to the registration roller pair 76 (hereinafter, referred to as "sheet re-feeding timing"). Starting the operation of the double-sided motor 205 leads the drive of the double-sided rollers 88 and 89 to start, and then the conveyance of the sheet P kept stopped at the standby position starts again. Thus, heretofore, the sheet P stops at one standby position until the sheet re-feeding timing is reached.

The image forming apparatus 1 according to the present exemplary embodiment will be described. The conventional standby control of the sheet P at the time of the double-sided conveyance has only one standby position for the sheet P. This means that the sheet P is stopped temporarily at the same position for a long time. If the sheet P passing the fixing unit is stopped at the same position for a long time, water in the sheet P is discharged as water vapor by heat at the time of fixing. The water vapor forms dew and sticks to the conveyance guide forming the double-sided conveyance path 85 into a water droplet. The water droplet permeates the sheet P being stopped on the conveyance guide to which the water vapor sticks and the succeeding sheet P. An image transferred to the sheet P which the water droplet permeates is liable to become a whitish image. This may cause image defect due to dew condensation in the process of image formation.

The time for which water vapor is discharged from the sheet P and the quantity of the water vapor discharged therefrom are different depending on air permeance of the sheet P, which makes it difficult to propose a configuration that does not cause the dew condensation for all materials only at one standby position. The term "air permeance of the sheet P" refers to a degree to which air passes through the sheet P in a direction of depth thereof, and is a physical property of the sheet P measured by a Gurley permeability tester as a widely used parameter. The air permeance is represented by the number of seconds required for a certain volume of air under a certain differential pressure to pass the sheet P with a certain area. In general, plain paper tends to be low in air permeance and coated paper tends to be high in air permeance. The air permeance of the plain paper is about 100 seconds and that of the coated paper is about 10000 seconds.

In general, if the sheet P passing the fixing unit 5 is heated, moisture contained in the sheet P is discharged outside as water vapor. If the sheet P is plain paper, for example, the air permeance thereof is relatively low. Therefore, the time required for the water vapor contained in the plain paper to be discharged is estimated to be short. The water vapor tends to continue to be discharged until the sheet P is conveyed to a position nearer to the fixing unit 5 on the double-sided conveyance path 85. For this reason, when the plain paper reaches the standby position in the conventional configuration from the fixing unit 5, the discharge of the water vapor from the inside of the plain paper is already finished.

If the sheet P is coated paper, for example, the air permeance thereof is relatively high. The water vapor tends to continue to be discharged if the sheet P is conveyed to a position farther from the fixing unit 5 on the double-sided conveyance path 85. For this reason, the water vapor continues to be discharged from the inside of the coated paper even after the coated paper reaches the standby position in the conventional configuration from the fixing unit 5, so that the coated paper tends to cause image defect due to dew condensation more often than the plain paper.

Figure 3:
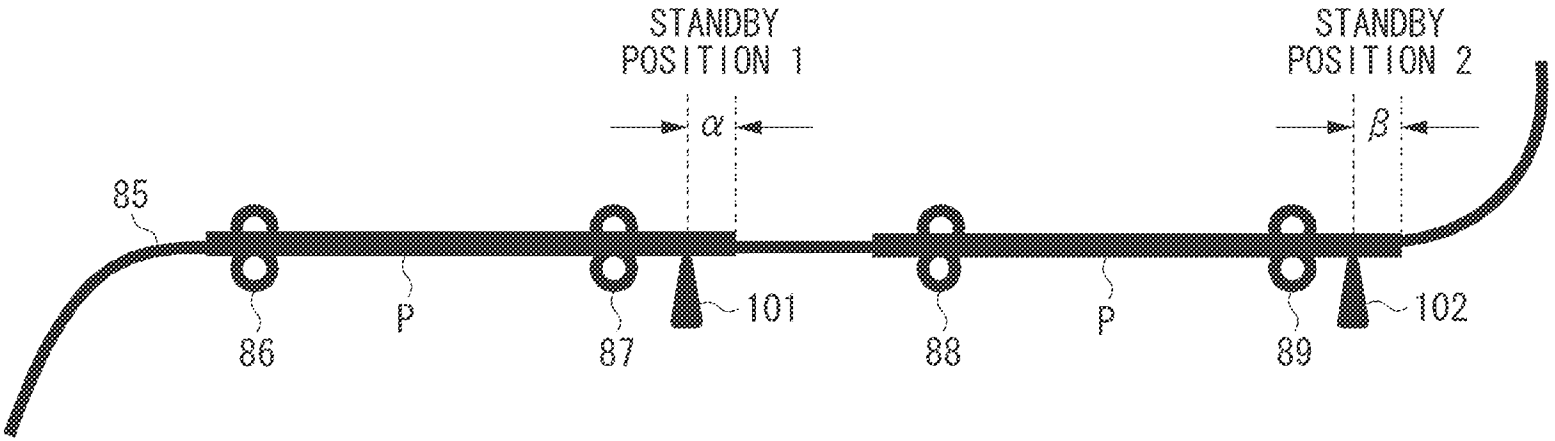
FIG. 3 illustrates double-sided standby positions according to the exemplary embodiment.

In the present exemplary embodiment, a plurality of standby positions are provided on the double-sided conveyance path 85, and the stopping times at the respective standby positions are changed according to the air permeance of the sheet P, in other words, according to the characteristic of discharge of water vapor. Thereby, image defect due to dew condensation resulting from the sheet P is prevented in the present exemplary embodiment. FIG. 3 illustrates the standby position on the double-sided conveyance path 85 of the sheet P according to the present exemplary embodiment. In the present exemplary embodiment, it is presumed that the sheet is equal to or shorter in length than an A4 size sheet or a letter-size sheet in the conveyance direction. In the present exemplary embodiment, two standby positions where the sheet P can be stopped are provided so that the leading edge of the sheet P can stop on the respective downstream sides of the conveyance sensors 101 and 102. More specifically, a position where the leading edge of the sheet P reaches the downstream side away by a distance $\alpha$, 20 mm, for example, from the conveyance sensor 101 positioned on the downstream side of the double-sided roller 87 is taken as a first standby position (hereinafter referred to as a standby position 1). In addition, a position where the leading edge of the sheet P reaches the downstream side away by a distance $\beta$, 20 mm, for example, from the conveyance sensor 102 positioned on the downstream side of the double-sided roller 89 is taken as a second standby position (hereinafter referred to as a standby position 2). The first and second standby positions are determined in consideration of distances between the double-sided roller 87 and the conveyance sensor 101 and between the double-sided roller 89 and the conveyance sensor 102.

(Standby Control of Sheet P in Double-Sided Conveyance)

Figure 4A:
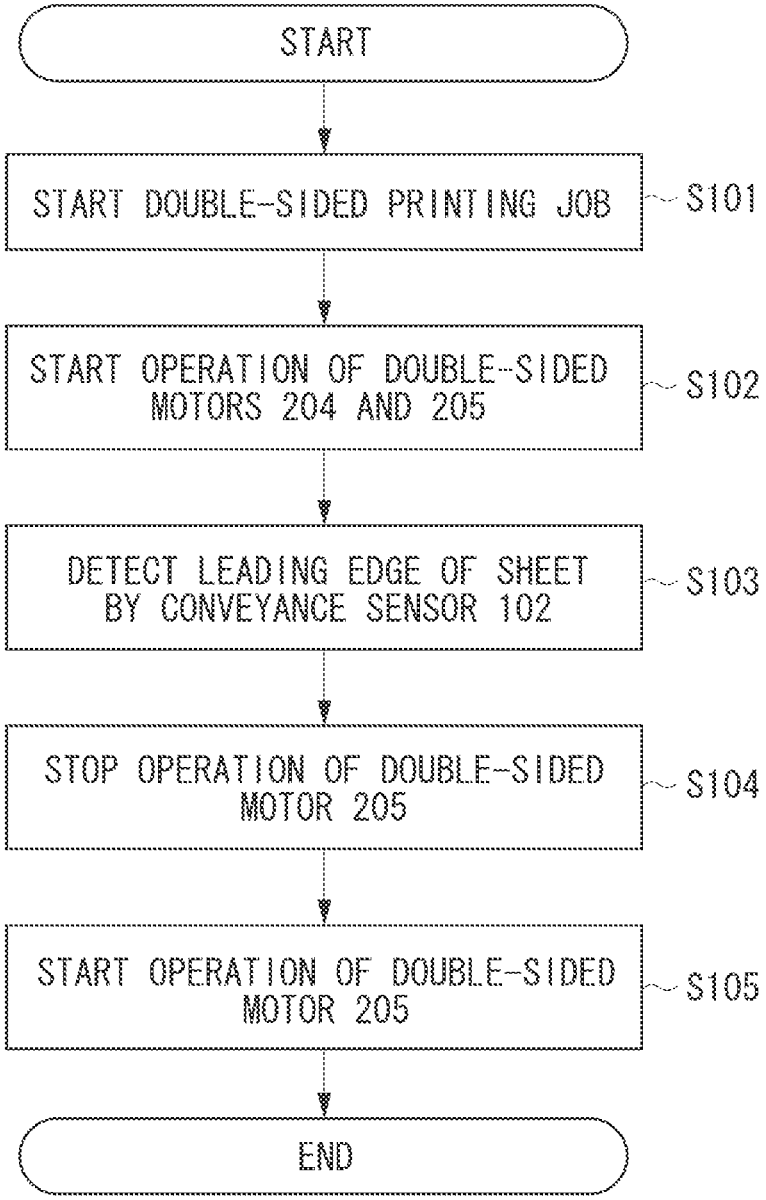
FIGS. 4A and 4B are flowcharts describing standby control of a sheet according to the exemplary embodiment.
Figure 4B:
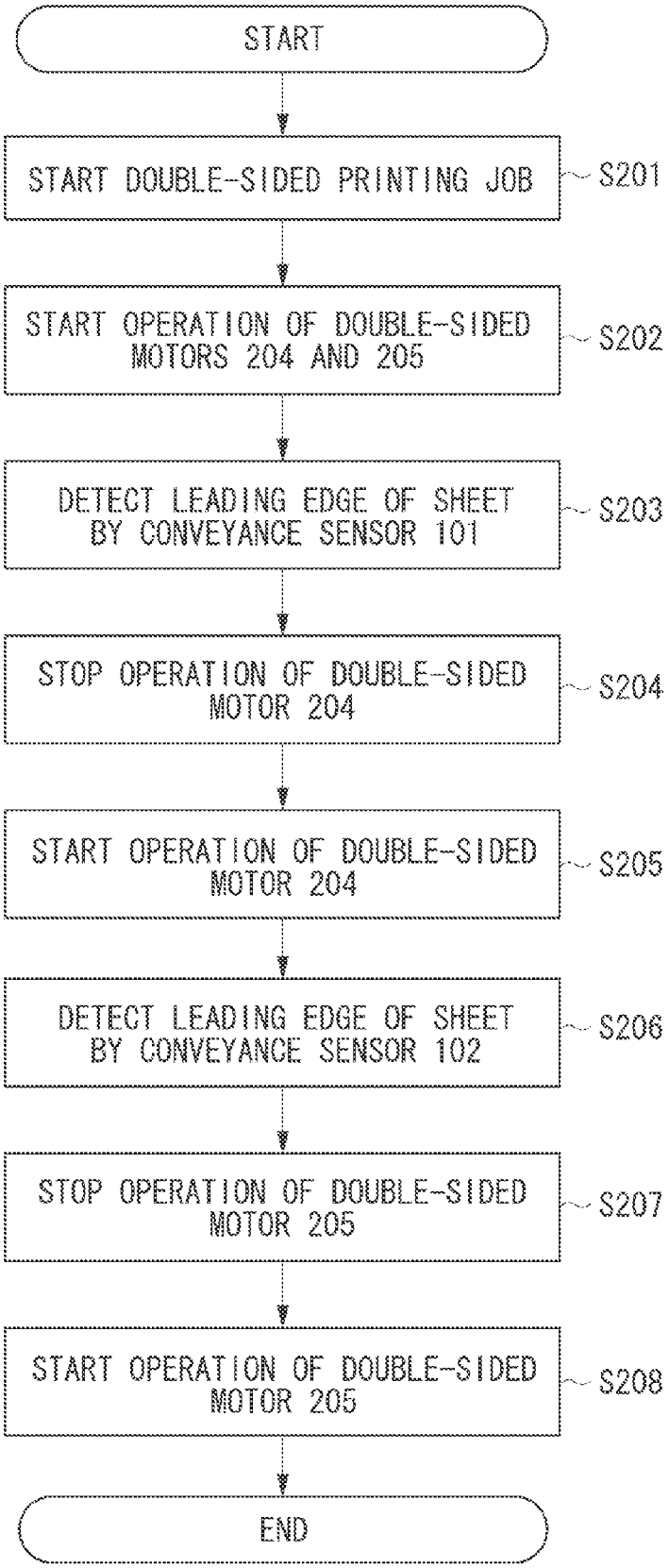

FIGS. 4A and 4B are flowcharts describing standby control of sheet P in the double-sided conveyance according to the present exemplary embodiment. As described above, if the sheet P is the plain paper, when the sheet P is conveyed to the double-sided conveyance path 85, almost all of the water vapor contained in the sheet P is discharged while the sheet P is being conveyed in the vicinity of the fixing unit 5. For this reason, if the sheet P is a material whose air permeance is low, such as the plain paper (hereinafter referred to as material 1), control is performed so that the sheet P is stopped only in the standby position 2. FIG. 4A is a flowchart illustrating the standby control in a case where the sheet P is the material 1. The processes performed in steps S101 to S105 in FIG. 4A illustrating the standby control in a case where the sheet P is the material 1 are similar to the processes performed in steps S901 to S905 described in FIG. 2B, so that the description thereof is omitted.

(In a Case Where Sheet P is Coated Paper)

If the sheet P is the coated paper, the coated paper is conveyed with water vapor contained therein, as described above. For this reason, in the present exemplary embodiment, if the sheet P is a material whose air permeance is high such as the coated paper (hereinafter referred to as material 2), the sheet P is caused to be stopped at a plurality of standby positions. Specifically, the controller 50 performs control so that the sheet P is stopped at both of the standby positions 1 and 2. That is, if the sheet P is the material 2, the time for which the sheet P stops at the standby position 2 is shorter than that in a case where the sheet P is the plain paper. The amount of the water vapor to be discharged, when the sheet P stops at the standby position 2, is reduced to suppress the generation of dew condensation at the standby position 2. FIG. 4B is a flowchart illustrating the standby control in a case where the sheet P is the material 2. The processes performed in steps S201 and S202 in FIG. 4B illustrating the standby control in a case where the sheet P is the material 2 are similar to the processes performed in steps S101 and S102 described in FIG. 4A illustrating the control in a case where the sheet P is the material 1, so that the description thereof is omitted.

In step S203, if the controller 50 detects the leading edge of the sheet P by the conveyance sensor 101, the controller 50 resets and starts the timer 50*d*. In step S204, the controller 50 measures a predetermined time by the timer 50*d* and stops the operation of the double-sided motor 204. Stopping the operation of the double-sided motor 204 leads the drive of the double-sided rollers 86 and 87 to stop. The controller 50 determines the predetermined time until the leading edge of the sheet P reaches the standby position 1 after the conveyance sensor 101 detects the leading edge of the sheet P, in the following manner. The controller 50 determines the predetermined time based on a distance of 20 mm along the double-sided conveyance path 85 from the conveyance sensor 101 to the standby position 1 and a predetermined conveyance speed of the sheet P. As illustrated in FIG. 4A, in a case where the sheet P is the material 1, even if the conveyance sensor 101 detects the leading edge of the sheet P, the sheet P of the material 1 is not on standby at the standby position 1. The controller 50 causes the timer 50*d* to measure the time for which the double-sided motor 204 stops, that is, the time for which the sheet P is stopped at the standby position 1 based on the timing at which the double-sided motor 204 stops. The time for which the controller 50 stops the double-sided motor 204 is the one that is optimized according to the material of the sheet P.

In step S205, when the controller 50 causes the timer 50*d* to measure the time for which the double-sided motor 204 stops (the stopping time of the sheet P), the controller 50 starts the operation of the double-sided motor 204. Resuming the operation of the double-sided motor 204 leads the drive of the double-sided rollers 86 and 87 to resume, and the conveyance of the sheet P resumes. In step S206, the controller 50 resets and starts the timer 50*d* according to the fact that the leading edge of the sheet P is detected by the conveyance sensor 102 arranged on the downstream side of the double-sided roller 89. In step S207, if the timer 50*d* measures a predetermined time, the controller 50 stops the operation of the double-sided motor 205. Stopping the operation of the double-sided motor 205 leads the drive of the double-sided rollers 88 and 89 to stop. In step S208, the controller 50 starts the operation of the double-sided motor 205 at the timing when the sheet P is fed again to the registration roller pair 76. Starting the operation of the double-sided motor 205 leads the drive of the double-sided rollers 88 and 89 to start, and the conveyance of the sheet P kept stopped at the standby position 2 resumes.

Figure 5A:
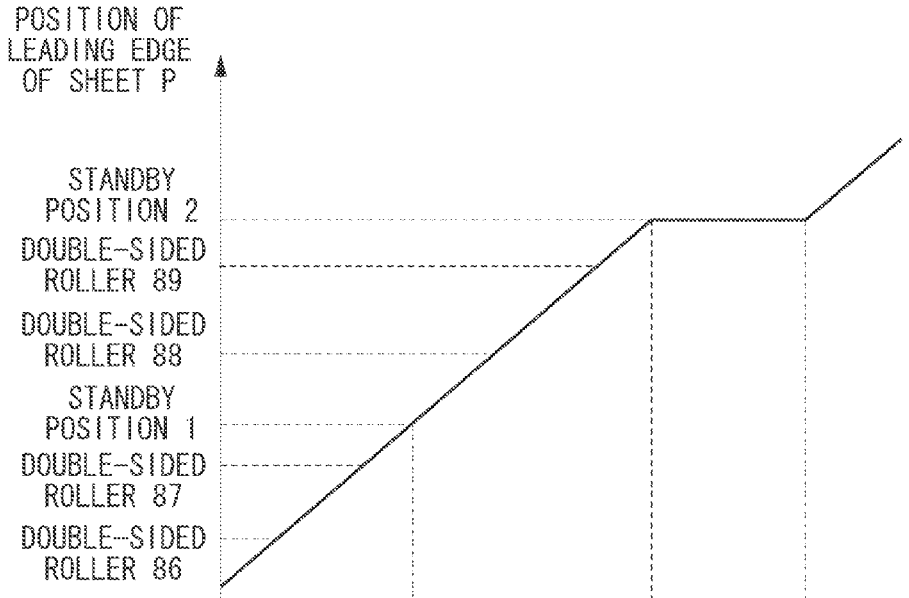
FIGS. 5A, 5B, and 5C are charts illustrating standby control using a material 1 as the sheet.
Figure 5B:
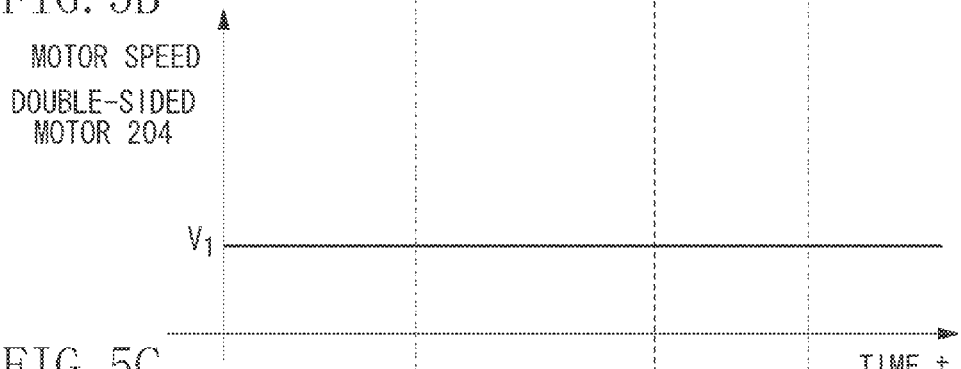
Figure 5C:
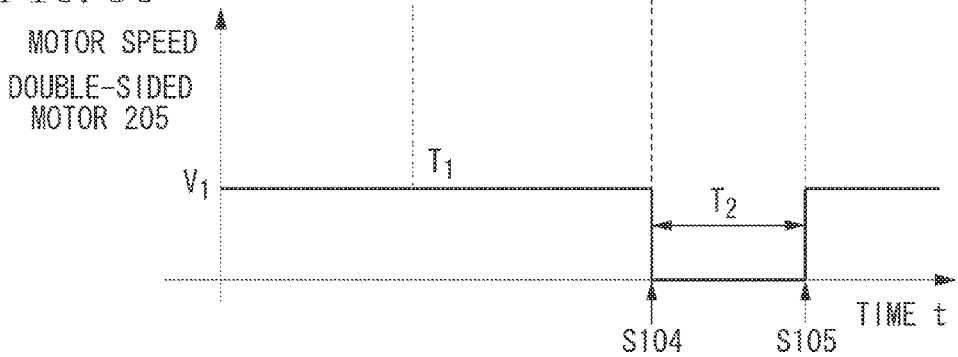
Figure 6A:
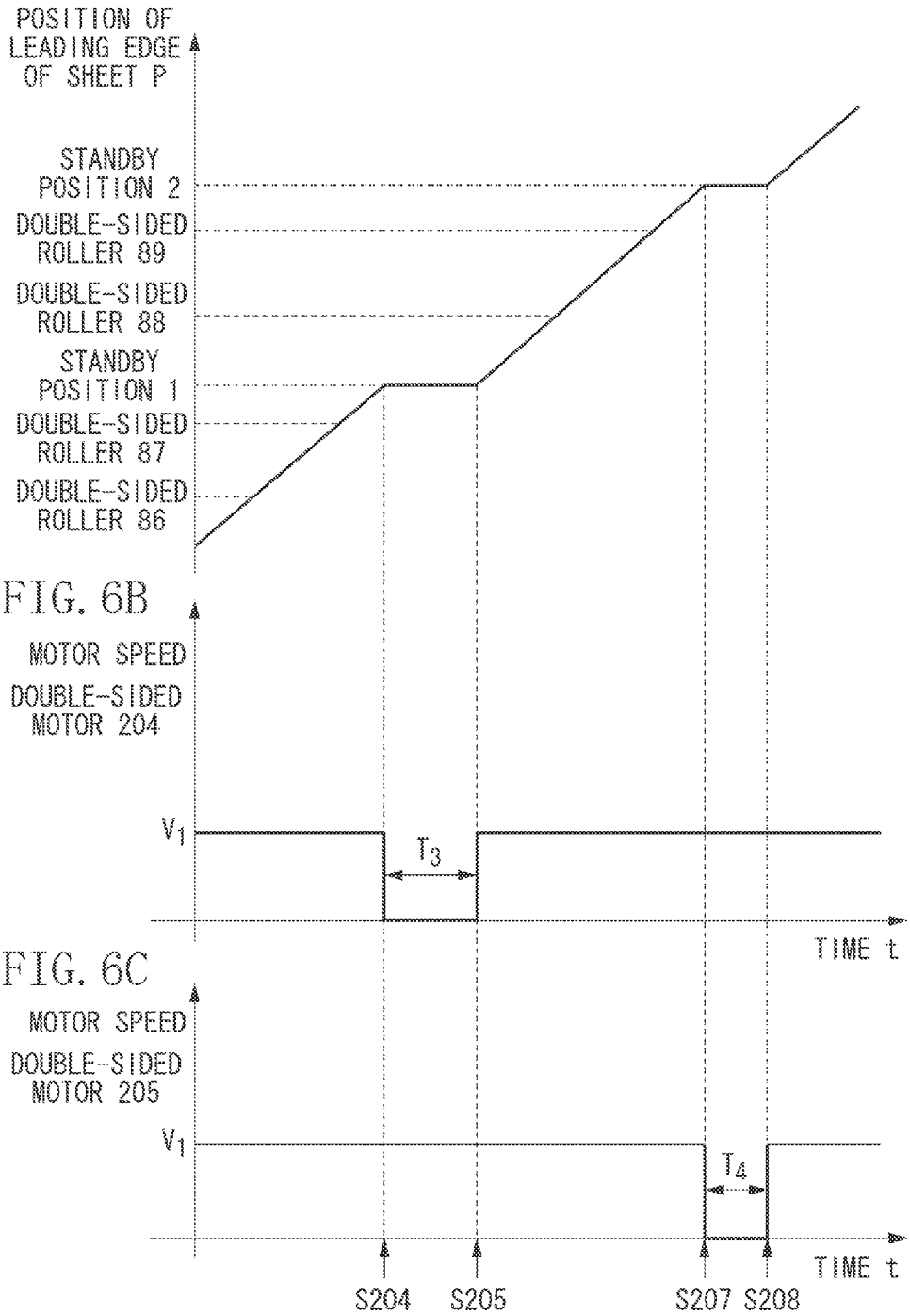

FIGS. 5A to 5C and FIGS. 6A to 6C illustrate timing charts in conveyance control for the sheets of the materials 1 and 2. The sheets of the materials 1 and 2 are presumed to be conveyed at the same process speed (or the conveyance speed of the sheet P at the time of forming an image). Since the standby position and the stopping time in the double-sided printing are different between the materials 1 and 2, the re-feeding timing in the double-sided printing is presumed to be the same between the materials 1 and 2. Thus, control is performed not to lower the productivity of the total double-sided printing. FIGS. 5A to 5C illustrate the conveyance control in the double-sided printing in a case where the sheet P is the material 1. FIGS. 6A to 6C illustrate the conveyance control in the double-sided printing in a case where the sheet P is the material 2.

(For the Case of Material 1)

FIG. 5A indicates positions of leading edge of the sheet P on a vertical axis. FIG. 5B indicates the speed of the double-sided motor 204 (motor speed) on a vertical axis. FIG. 5C indicates the speed of the double-sided motor 205 (motor speed) on a vertical axis. The horizontal axes thereof indicate time t. In a case where the sheet P is the plain paper using the material 1, the sheet P is conveyed by the double-sided rollers 86 to 89 while the sheet P is conveyed to the double-sided conveyance path 85 and until the leading edge of the sheet P reaches the standby position 2. As illustrated in FIGS. 5B and 5C, the double-sided motor 204 driving the double-sided rollers 86 and 87 operates at a constant speed $v_1$=340 mm/s. The double-sided motor 205 driving the double-sided rollers 88 and 89 operates also at the same constant speed $v_1$=340 mm/s. The constant speed $v_1$=340 mm/s of the double-sided motors 204 and 205 is the process speed.

Thus, in a case where the sheet P is the material 1, the sheet P does not stop at the standby position 1. The stopping time at the standby position 1 becomes T1=0 ms. When the leading edge of the sheet P reaches the standby position 2, that is, the position on the downstream side away by 20 mm from the conveyance sensor 102, as described in step S104 in FIG. 4A, the operation of the double-sided motor 205 stops, and the conveyance of the sheet P stops. Thereafter, the double-sided motor 205 starts again driving at a speed of v1=340 mm/s at a paper re-feeding timing (the timing in step S105 in FIG. 4A) when the stopping time T2 (T2=500 ms, for example) elapses after the double-sided motor 205 stops, and the sheet P is fed again. In other words, in a case where the sheet P is the material 1, the time for which the sheet P remains at the same position is zero or very short in the period water vapor is emitting, so that the generation of dew condensation is suppressed.

(For the Case of Material 2)

The vertical and horizontal axes of graphs in FIGS. 6A to 6C correspond to those in FIGS. 5A to 5C, so that the description thereof is omitted. In a case where the sheet P is the material 2 such as the coated paper, the sheet P is conveyed by the double-sided rollers 86 and 87 while the sheet P is conveyed to the double-sided conveyance path 85 and until the leading edge of the sheet P reaches the standby position 1. As illustrated in FIG. 6B, the double-sided motor 204 driving the double-sided rollers 86 and 87 operates at a constant speed v1=340 mm/s. When the leading edge of the sheet P reaches the standby position 1, that is, the position on the downstream side is away by 20 mm from the conveyance sensor 101, the operation of the double-sided motor 204 stops at the timing in step S204 in FIG. 4B. Accordingly, the drive of the double-sided rollers 86 and 87 stops, and then the conveyance of the sheet P stops. Thereafter, the double-sided motor 204 starts again driving at a speed of v1=340 mm/s at the timing (the timing in step S205 in FIG. 4B) when the stopping time T3=300 ms elapses after the double-sided motor 204 stops, and the conveyance of the sheet P resumes.

The sheet P is conveyed by the double-sided rollers 88 and 89 until the sheet P reaches the standby position 2 after the conveyance of the sheet P resumes. As illustrated in FIG. 6C, the double-sided motor 205 driving the double-sided rollers 88 and 89 operates at a constant speed $v_1$=340 mm/s. When the leading edge of the sheet P reaches the standby position 2, that is, the position on the downstream side away by 20 mm from the conveyance sensor 102, the operation of the double-sided motor 205 stops at the timing in step S207 in FIG. 4B. Thereby, the drive of the double-sided rollers 88 and 89 stops, and the conveyance of the sheet P stops. Thereafter, the double-sided motor 205 starts again driving at a speed of $v_1$=340 mm/s at the paper re-feeding timing (the timing in step S208 in FIG. 4B) when the stopping time $T_4$=200 ms elapses after the double-sided motor 205 stops, and the sheet P is fed again. In other words, in a case where the sheet P is the material 2, the time for which the sheet P remains at the same position is dispersed in the period when water vapor is discharged, so that the generation of dew condensation is suppressed.

A relation between a stopping time $T_1$ (0 ms) at the standby position 1 in a case where the sheet P is the material 1 and the stopping time $T_3$ (300 ms) at the standby position 1 in a case where the sheet P is the material 2 is represented by $T_1<T_3$. More specifically, the sheet P of the material 2 such as the coated paper, for example, which is high in air permeance, is stopped for a longer time than the material 1 at the standby position 1 which is on the downstream side of the fixing unit 5 and nearer the fixing unit 5 to allow suppressing dew condensation. In a case where the sheet P is the material 2, the stopping time is set so that a relation of $T_3>T_4$ can be held between a stopping time $T_3$ at the standby position 1 and the stopping time $T_4$ at the standby position 2. In other words, in a case where the sheet P is the material 2, the dew condensation can be suppressed by reducing the stopping time at the standby position 2 being far from the fixing unit 5 which is liable to form dew condensation rather than at the standby position 1 which is on the downstream side of the fixing unit 5 and near the fixing unit 5.

A relation between the stopping time $T_2$ (500 ms) at the standby position 2 in a case where the sheet P is the material 1 and the stopping time $T_4$ (200 ms) at the standby position 2 in a case where the sheet P is the material 2 is represented by $T_2>T_4$. In other words, in the material 1 such as the plain paper, for example, which is low in air permeance, the sheet P is stopped at the standby position 2 which is on the downstream side of the fixing unit 5 and is far from the fixing unit 5 to allow the generation of dew condensation to be suppressed.

In a case where the sheets of the materials 1 and 2 are conveyed at the same process speed, a total sum of the stopping times in the material 1 ($T_1+T_2$=0 ms+500 ms=500 ms) is equal to a total sum of the stopping times in the material 2 ($T_3+T_4$=300 ms+200 ms=500 ms). That is, in a case where the sheets of the materials 1 and 2 are conveyed at the same process speed, the sum total of the stopping times is constant irrespective of the material of the sheet P. Such total sum of the stopping times includes the time required for the motor to stop and start. Therefore, the actual total sum of the respective stopping times at the standby positions for the sheet P of the material 2, which more frequently stops, is slightly shorter. Accordingly, the timing at which the sheet P is re-fed from the double-sided conveyance path 85 to the registration roller pair 76 is the same, irrespective of the material. That is, the time until the sheet is conveyed again from the standby position 2 after the sheet passes the fixing unit is the same, irrespective of the material. Thereby, the productivity of the total double-sided printing is not lowered depending on the material.

The present exemplary embodiment describes the case where the sheets of the materials 1 and 2 are conveyed at the same process speed (340 mm/s, for example). On the other hand, if the process speed is different depending on the material for the sheet P, the respective stopping times at the standby positions 1 and 2 are set to the paper re-feeding timing according to each process speed.

As described above, according to the present exemplary embodiment, the generation of the dew condensation in the image forming apparatus can be lowered at a low cost without productivity being lowered.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107211, filed May 23, 2014, which is hereby incorporated by reference herein in its entirety.

What is claimed is:

1. An image forming apparatus comprising:

an image forming unit configured to form a toner image on a sheet;

a fixing unit configured to fix the toner image formed by the image forming unit on the sheet;

a double-sided conveyance path along which the sheet is conveyed to form, after a toner image is fixed to one face of the sheet by the fixing unit, a toner image on the other face of the sheet; and a control unit configured to control conveyance of the sheet, allowing the sheet to be stopped at a first standby position which is more downstream than the fixing unit in a sheet conveyance direction on the double-sided conveyance path and at a second standby position which is more downstream than the first standby position, and changing stopping time for which the sheet is stopped at the first standby position and stopping time for which the sheet is stopped at the second standby position according to a material of the sheet.

2. The image forming apparatus according to claim 1, wherein the control unit makes the stopping time longer at the second standby position than that at the first standby position if the sheet is a first material, and makes the stopping time longer at the first standby position than that at the second standby position if the sheet is a second material having lower air permeance than the first material.

3. The image forming apparatus according to claim 2, wherein the control unit makes the stopping time at the first standby position to be zero, if the sheet is the first material.

4. The image forming apparatus according to claim 2, wherein the first material is plain paper and the second material is coated paper.

5. The image forming apparatus according to claim 2, wherein the stopping time until the sheet of the first material is conveyed from the second standby position after the sheet passes the fixing unit is equal to the stopping time until the sheet of the second material is conveyed from the second standby position after the sheet passes the fixing unit.

6. The image forming apparatus according to claim 2, wherein a conveyance speed at a time of forming an image on the sheet of the first material is equal to a conveyance speed at a time of forming an image on the sheet of the second material.

7. The image forming apparatus according to claim 2, wherein a sum of the stopping time for which the sheet of the first material is stopped at the first standby position and the stopping time for which the sheet of the first material is stopped at the second standby position is equal to a sum of the stopping time for which the sheet of the second material is stopped at the first standby position and the stopping time for which the sheet of the second material is stopped at the second standby position.

8. The image forming apparatus according to claim 1, further comprising a first detecting unit which is provided more downstream than the fixing unit in the sheet conveyance direction and detects a sheet, wherein the control unit determines that the sheet reaches the first standby position based on a detection result of the first detecting unit.

9. The image forming apparatus according to claim 8, further comprising a first conveyance unit which is provided between the fixing unit and the first detecting unit and conveys a sheet, wherein, if the control unit determines that the sheet reaches the first standby position based on the detection result of the first detecting unit, the control unit stops an operation of the first conveyance unit to cause the sheet to be stopped at the first standby position.

10. The image forming apparatus according to claim 9, wherein the control unit starts an operation of the first conveyance unit after the stopping time elapses at the first standby position.

11. The image forming apparatus according to claim 8, further comprising a second detecting unit which is provided more downstream than the first detecting unit and detects a sheet, wherein the control unit determines that the sheet reaches the second standby position based on a detection result of the second detecting unit.

12. The image forming apparatus according to claim 11, further comprising a second conveyance unit which is provided between the first and second detecting units and conveys the sheet, wherein, if the control unit determines that the sheet reaches the second standby position based on the detection result of the second detecting unit, the control unit stops an operation of the second conveyance unit to cause the sheet to be stopped at the second standby position.

13. The image forming apparatus according to claim 12, wherein the control unit starts an operation of the second conveyance unit after the stopping time elapses at the second standby position.

14. An image forming apparatus comprising:

an image forming unit configured to form a toner image on a sheet;

a fixing unit configured to fix the toner image formed by the image forming unit on the sheet;

a double-sided conveyance path along which the sheet is conveyed to form, after a toner image is fixed to one face of the sheet by the fixing unit, a toner image on the other face of the sheet, a conveying unit configured to convey the sheet along the double-sided conveyance path, wherein the double-sided conveyance path includes a first standby position where a sheet is stoppable, and a second standby position downstream to the first standby position with respect to a sheet conveyance direction; and a control unit configured to control the conveying unit so that a sheet conveyed on the double-sided conveyance path is stopped at the second standby position, and the sheet is conveyed from the second standby position to the image forming unit at a predetermined timing, wherein the control unit controls the conveying unit so that a sheet is stopped at the second standby position without stopping at the first standby position in a case where a first-type sheet is conveyed on the double-sided conveyance path, and so that a sheet is stopped at both the first standby position and the second standby position in a case where a second-type sheet is conveyed on the double-sided conveyance path.

15. The image forming apparatus according to claim 14, wherein an air permeability of the second-type sheet is lower than that of the first-type sheet.

16. The image forming apparatus according to claim 14, wherein, in a case where a sheet is the second-type sheet, the control unit controls the conveying unit so that a time period while the sheet stops at the first standby position to be longer than a time period while the sheet stops at the second standby position.

17. The image forming apparatus according to claim 15, wherein the first-type sheet is plain paper and the second-type sheet is coated paper.

18. The image forming apparatus according to claim 14, wherein, regardless of whether a sheet is in the first-type or the second-type, the control unit controls so that the sheet that reached to the second standby position if conveyed from the second standby position at a predetermined timing.

19. An image forming apparatus comprising:

an image forming unit configured to form a toner image on a sheet; a fixing unit configured to fix the toner image formed by the image forming unit on the sheet;

a double-sided conveyance path along which the sheet is conveyed to form, after a toner image is fixed to one face of the sheet by the fixing unit, a toner image on the other face of the sheet;

a conveying unit configured to convey the sheet along the double-sided conveyance path, wherein the double-sided conveyance path includes a standby position at which the sheet stops; and a control unit configured to control the conveying unit so that the sheet conveyed on the double-sided conveyance path is stopped at the standby position, and the sheet is conveyed from the standby position to the image forming unit at a predetermined timing, wherein the control unit controls the conveying unit so that a time period required to convey the sheet from the fixing unit to the standby position is changed according to material property of the sheet.

20. The image forming apparatus according to claim 19, wherein the control unit controls the conveying unit so that a conveyance time required when material property of a sheet is a second-type to be longer than a conveyance time required when material property of a sheet is a first-type, and air permeability of the second-type sheet is lower than that of the first-type sheet.

21. The image forming apparatus according to claim 20, wherein, regardless of material properties of sheets, the control unit controls the conveying unit so that a timing of a sheet conveyed from the standby position to be same.

22. The image forming apparatus according to claim 20, wherein the first-type sheet is plain paper and the second-type sheet is coated paper.

* * * * *